United States Patent [19]

Spademan

[11] 4,382,342

[45] May 10, 1983

[54] DYNAMIC INTERNAL FITTING SYSTEM FOR A SPORT SHOE

[76] Inventor: Richard G. Spademan, 933 Addison St., Palo Alto, Calif. 94301

[21] Appl. No.: 886,946

[22] Filed: Mar. 15, 1978

[51] Int. Cl.[3] ..... A43B 5/04

[52] U.S. Cl. ..... 36/119

[58] Field of Search ..... 36/117, 119, 120, 121

[56] References Cited

U.S. PATENT DOCUMENTS 4,030,215 6/1977 Vogel ..... 36/119

FOREIGN PATENT DOCUMENTS 1802710 10/1968 Fed. Rep. of Germany ..... 36/119

2712001 9/1977 Fed. Rep. of Germany ..... 36/119

*Primary Examiner*—Patrick D. Lawson

*Attorney, Agent, or Firm*—Townsend and Townsend

[57] ABSTRACT

A dynamic internal fitting system for a ski boot having a lower shell member and an upper cuff member. Interior of the ski boot there is provided a pair of strap members for engaging the lateral and dorsal aspects of a foot. One end of the strap members is attached to the sole of the ski boot. The opposite end of the strap members is connected to one end of a cable by means of a pivotable linking member. The cable extends from the linking member and is connected at its opposite end to a pulley. The pulley is releasably coupled to the cuff member and means are provided for manually selectively adjusting the length of the cable wrapped about the pulley. During skiing maneuvers, as the position of the foot changes in the boot, the linking member pivots for dynamically adjusting the tension applied to and the position of the strap members relative to the foot engaged thereby. Additionally, as the cuff member pivots relative to the shell member, the pulley rotates with the cuff member.

In another embodiment in a ski boot, there is provided a tongue member, a pair of cables extending from opposite lateral sides of the tongue member, and a pair of pulleys coupled to the opposite sides of an upper cuff member. Each of the cables is connected to a separate pulley. The pulleys are releasably coupled to the cuff member and rotate with the cuff member for dynamically adjusting the tension applied to and the position of the tongue member relative to the foot engaged thereby. In one embodiment, each of the pulleys is separately adjusted relative to the cuff member for adjusting the tension applied to and the position of the tongue member relative to the foot. In an alternative embodiment, both of the pulleys are connected to a common shaft and are adjusted together relative to the cuff member.

28 Claims, 12 Drawing Figures

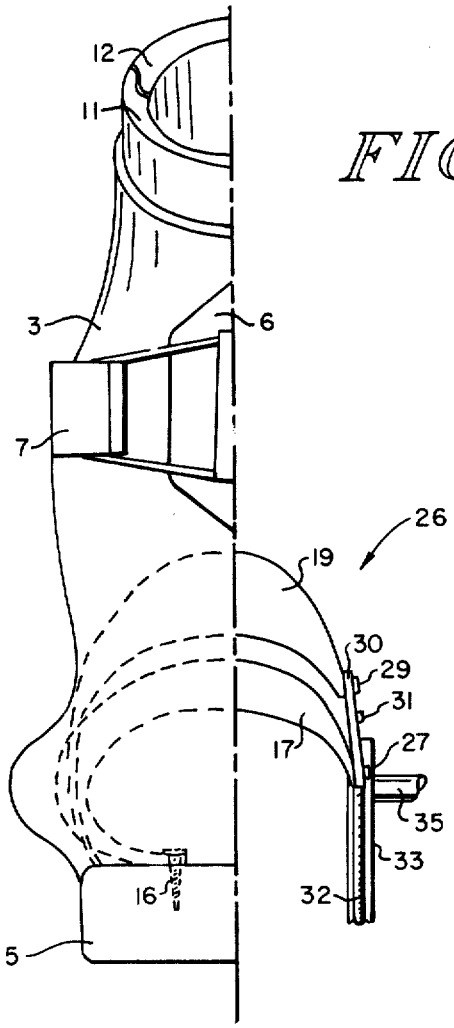
FIG. 5
FIG. 4
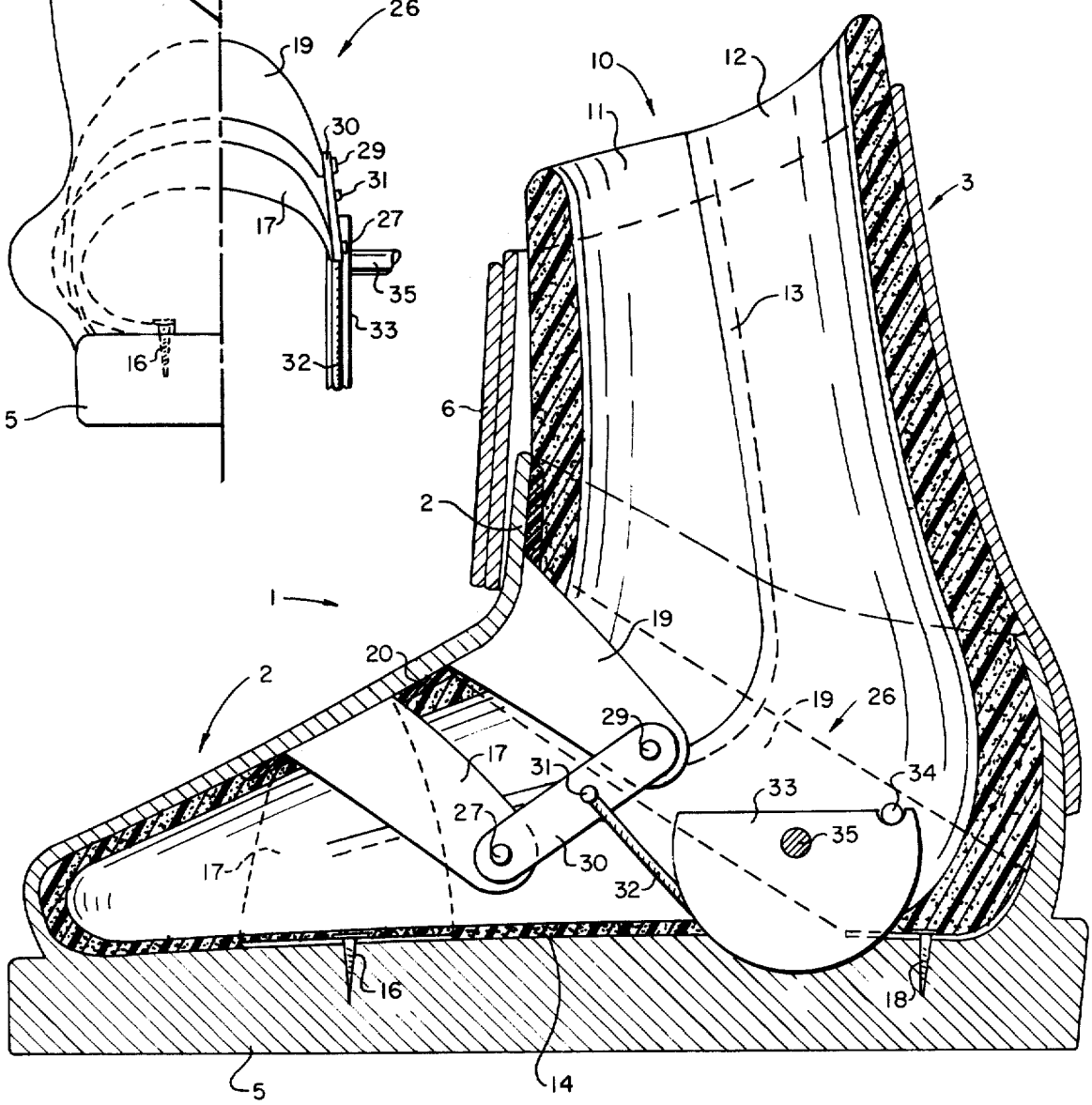

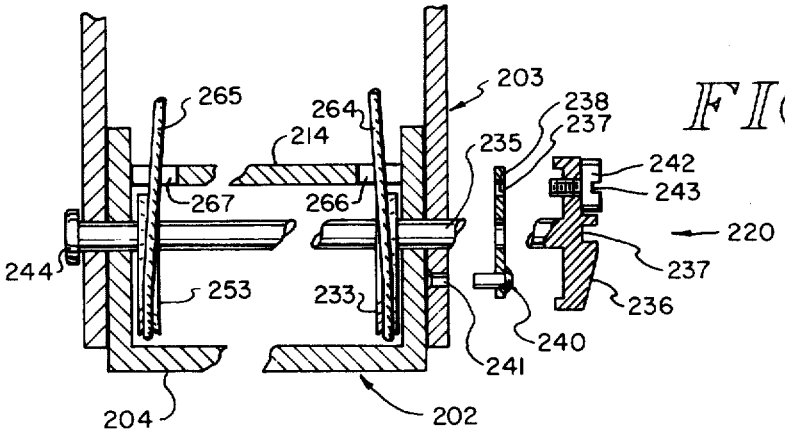
FIG. 9
FIG. 8
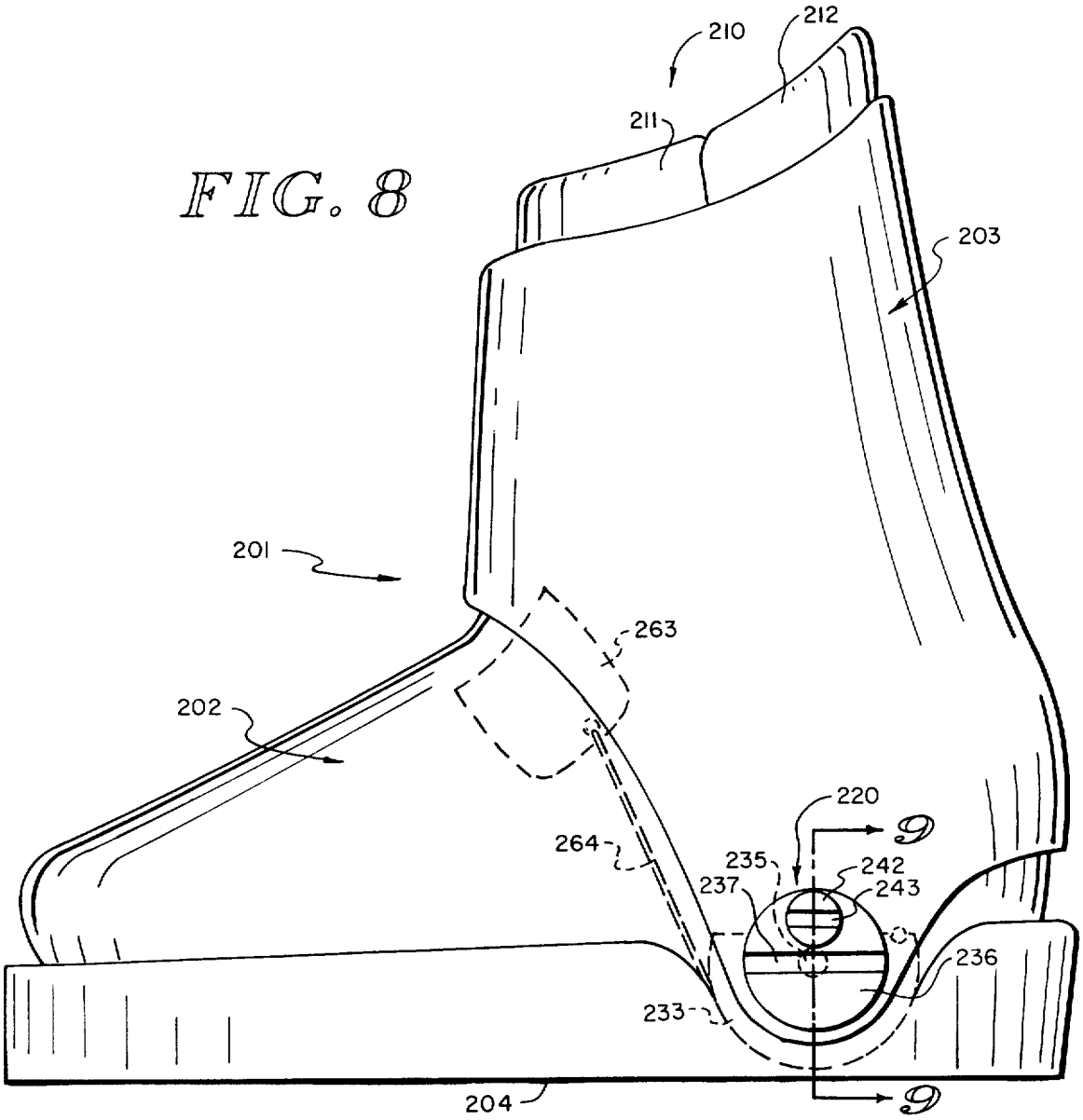

DYNAMIC INTERNAL FITTING SYSTEM FOR A SPORT SHOE

BACKGROUND OF THE INVENTION

The present invention relates to internal fitting systems for sport shoes in general and in particular to a novel internal fitting system for a ski boot or the like.

A conventional ski boot as presently used in downhill skiing with a ski release binding typically comprises a relatively rigid exterior lower shell member and upper cuff member and a relatively soft interior liner. The shell member and cuff member are designed to provide mechanical protection and support for a foot, ankle and lower leg and to provide a stable means for releasably securing the boot to a ski. The shell member and cuff member usually are pivotably coupled in the proximity of the ankle. Boots constructed with a pivoting cuff member generally provide restraint against excess sideways and rearward bending at the ankle while providing limited forward bending of the leg relative to the foot. Less commonly, boots are constructed without a pivoting cuff member and forward bending is restricted or accomplished by providing for a separation of the upper forward section of the cuff member.

The relatively rigid exterior lower shell member and upper cuff member in conjunction with the relatively soft interior liner should also provide restraint against upward, forward, rearward and sideways movement of the foot. This restraint is desirable to minimize foot discomfort and fatigue from recurring pressure areas and continual movement of the foot in the boot and to control the skis during various skiing maneuvers and in various terrain and snow conditions. Further, it is essential to minimize foot movement in order to maximize energy transmission between the foot and the release binding in a potential injury producing fall. In practice, the magnitude of restraint required from one moment to the next will vary as the skiing conditions and the maneuvers being executed change. Ideally, the boot should provide for a close, comfortable fit that does not compromise circulation and warmth for the tracking phase of skiing and provide for a momentary tighter fit for the turning phase of skiing and during a fall condition.

The design of conventional ski boots does not adequately compensate for the dynamic conditions that prevail in downhill skiing. With conventional boots, during a turn when skiing on packed snow, forward bending at the ankle is usually accompanied by a tendency for hindfoot upward movement and forefoot sideways movement because ski control and turning are usually accomplished by downward and sideways force applied to the forward leading edges of the skis. In powder snow, the forward leading edges are kept raised for planing on top of the snow with a tendency for forefoot upward and sideways movement. When maneuvering in snow of different consistencies or in bumpy or mogly terrain, and skier alternates, frequently and rapidly, between forward and rearward bending in the boots. As a result of this movement, ski control is significantly reduced. In most injury producing fall conditions, excess movement also reduces energy transmission between the foot and the release binding.

Because shell molds are expensive to manufacture, it is the practice to supply a limited number of shell sizes. Manufacturers then rely upon buckles with numerous and complex adjustments and liners of various configurations and constructions to provide a close, comfortable and warm fit, compensate for innumerable foot sizes and shapes, and to achieve the necessary foot restraint. However, these fitting arrangements are unsatisfactory. The use of buckles with numerous and complex adjustments usually results in a nonconforming fit. The buckle closure required to provide a close fit also usually results in uncomfortable pressure areas because of the consequent distortion of the relatively rigid shell. Additionally, conventional buckle arrangements usually do not adequately restrain the foot from sideways movement at the hindfoot and forefoot.

The use of liners of various configurations and constructions also usually results in a nonconforming fit. Because of the difficulty in supplying liner configurations that will accommodate the wide range of variation of foot sizes and shapes such as a splay or wide forefoot, wide base, angulated heel, halux valgus, boney prominences, spurs, high longitudinal arch or one foot in size variance with the other foot, liners are generally manufactured to conform to only a limited range of size and shape. Manufacturers then rely upon various liner constructions to provide a close comfortable fit. Among the constructions used there are included molded and sheet foam rubber, urethane foam, wax, cork, plastic beads, and other various flow materials. The numerous materials used is indicative of the unsatisfactory results. In spite of the above fitting arrangements, conventional boots do not provide adequate adjustment for comfort and restraint and a relatively large inventory of many shells and liner configurations and constructions is necessary to satisfy customer requirements. Moreover, a satisfactory fit in the ski shop is still often unsatisfactory on the ski slope because the foot is not necessarily fitted for skiing conditions.

SUMMARY OF THE INVENTION

In view of the foregoing, principal object of the present invention is a sport shoe fitting system, and in particular a ski boot fitting system, which reduces the number of shell sizes and liner configurations and constructions required to achieve a close comfortable and warm fit, and provide the necessary foot restraint over a wide range of foot sizes and foot shapes.

Another object of the present invention is a fitting system that requires only one adjustment to fit the foot.

Another object of the present invention is a fitting system that may may be easily and rapidly adjusted to the foot.

Another object of the present invention is a fitting system that may be adjusted from outside of the boot.

Another object of the present invention is a fitting system that may be readily opened and closed allowing easy insertion and removal of the foot from the boot.

Still other objects of the present invention include the following:

A fitting system that may change shape dynamically in response to changes in position of the foot during skiing maneuvers.

A fitting system that may accommodate to hindfoot upward movement during a turning phase of skiing by becoming tighter at the forefoot.

A fitting system that may accommodate to forward lean during a turning phase of skiing by becoming tighter at the hindfoot and forefoot.

A fitting system that may accommodate to forefoot upward movement during a turning phase of skiing by becoming tighter at the hindfoot.

A fitting system that may accommodate to a potential injury producing fall by becoming tighter at the hindfoot and forefoot.

A fitting system that may be elastic to absorb shock.

A fitting system that is not affected adversely by temperature and that allows for dead air space insulation.

A fitting system that is lightweight and is inexpensive to manufacture.

In accordance with the above objects, there is provided in a preferred embodiment of the present invention in a downhill skii boot having a lower shell member including a sole member and an upper cuff member, a pair of strap members. The first strap member is pivotably attached to the sole member at the forward end of the longitudinal arch and then passes around the lateral aspect of the forefoot and over the dorsum and is connected to the forward end of an elongated pivotable linking member. The second strap member is pivotably attached to the sole member at the rearward end of the longitudinal arch and then passes around the lateral aspect of the heel and over the instep and is connected to the rearward end of the linking member. The linking member is located on the superior medial aspect of the longitudinal arch. A cable is pivotably connected to the linking member intermediate the strap members and then extends along the medial aspect of the foot and is connected at its opposite end to a pulley. The pulley is located on the interior wall of the lower shell member and is releasably coupled to the upper cuff member. The length of cable wrapped about the pulley is adjusted by means of a knob member located on the exterior wall of the upper cuff member. The knob member is connected to the pulley by a shaft member which passes through a bore in the upper cuff member and lower shell member, which overlap and forms the pivot axis for the upper cuff member.

In fitting the ski boot, the knob member and pulley are rotated relative to the upper cuff member for manually selectively adjusting the length of cable wrapped about the pulley when the upper cuff member and lower shell member are in a given relative position. As the length of cable is adjusted, the linking member moves and pivots to accommodate the strap members to the foot size and shape. The strap members apply a force against the foot in a sideward, rearward and downward direction. Once the desired magnitude of tension is applied to the strap members, the knob and pulley are releasably locked to the upper cuff member.

During various skiing maneuvers, as the position of the foot changes in the boot, the linking member pivots for dynamically adjusting the tension applied to and the position of the strap members relative to the foot. Hindfoot upward movement causes the linking member to pivot in a counterclockwise direction tightening the strap member about the forefoot. Forefoot upward movement causes the linking member to pivot in a clockwise direction tightening the strap member about the hindfoot. Additionally, as the upper cuff member pivots relative to the lower shell member in forward lean, the pulley is rotated. As the pulley rotates, the length of cable wrapped about the pulley varies dynamically as a function of the relative position of the upper cuff member and lower shell member. As the length of cable wrapped about the pulley varies, the linking member further moves and pivots for adjusting the tension applied to and the position of the strap members relative to the foot.

In an alternative embodiment, there is provided a pulley connected to a linking member by a cable and a pair of strap members connected to the linking member and attached to the sole as described above. However, in this embodiment, the pulley is releasably coupled to the lower shell member by a knob member located on the exterior wall of the lower shell member for selectively adjusting the length of cable wrapped about the pulley. By coupling the pulley to the lower shell member of the ski boot, the upper cuff member may pivot forwardly or rearwardly without affecting the fit of the boot. At the same time, any tendency for forefoot or hindfoot movement is compensated for by a redistribution of the foot restraining forces by the linking member.

In another alternative embodiment, a tongue member is provided for engaging the upper surface of a foot in the area of the instep. The tongue member extends forwardly to the midfoot and rearwardly to the lower third of the leg and medially and laterally to the malleoli. Connected to the tongue member intermediate the ends is a pair of cables. One end of each of the pair of cables is connected to each of the opposite lateral edges of the tongue member, respectively, and the opposite end of the cables is connected to a corresponding pulley releasably coupled to the upper cuff member. In one embodiment, the pulleys are separately adjustable relative to the upper cuff member by means of a knob member selectively adjusting the length of cable wrapped about the pulleys when the upper cuff member and lower shell member are in a given relative position. In another embodiment, the pulleys are attached to a common shaft and are adjusted together for selectively adjusting the length of cable wrapped about the pulleys. In each of the latter embodiments, the pulleys are releasably coupled to the upper cuff member for dynamically adjusting the tension applied to and the position of the tongue member relative to the foot engaged thereby.

DESCRIPTION OF THE DRAWINGS

The above and other objects, features and advantages of the present invention will become apparent from the following detailed description of the accompanying drawings in which:

FIG. 4 is a side cross-section view of a ski boot showing the principal features of a preferred embodiment of the present invention.

FIG. 5 is a partial front elevation view of the principal features of FIG. 4.

FIG. 8 is a side elevation view of still another embodiment of the present invention.

FIG. 9 is a partial cross-section view taken in the direction of lines 9—9 of FIG. 8.

DETAILED DESCRIPTION OF THE DRAWINGS

Figure 2:
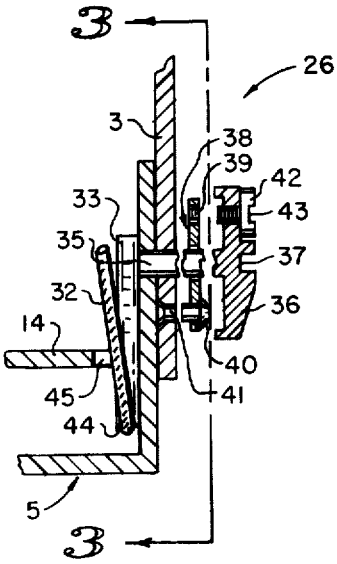
FIG. 2 is a partial cross-section view taken in the direction of lines 2—2 in FIG. 1.
Figure 3:
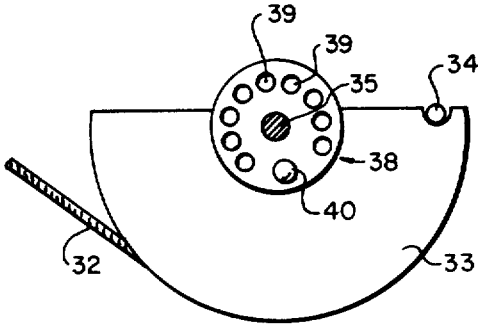
FIG. 3 is a partial side elevation view taken in the direction of lines 3—3 in FIG. 2.

Referring to FIGS. 1-5, there is provided, in accordance with the present invention, a ski boot designated generally as 1. In the ski boot 1 there is provided a lower shell member 2 and an upper cuff member 3. In the lower shell member 2 there is provided a sole member 5. The sole member 5 and the lower shell member 2 and upper cuff member 3 are relatively rigid and typically are made of plastic or similar material.

The upper cuff member 3 is provided with an extended portion forming a conventional front cuff flap 6 and a conventional single buckle assembly 7, as seen more clearly in FIGS. 4 and 5, for opening and closing the ski boot 1 and permitting the insertion and removal of a foot therefrom. Because of the fitting system of the present invention, and unlike conventional buckled ski boots, the ski boot 1, according to the present invention does not require buckles on the lower shell member 2, as will be apparent from the following description.

In the interior of the upper cuff member 3, and extending into the interior of the lower shell member 2 there is provided a liner designated generally as 10. In the liner 10 there is provided a forward section 11 and a rearward section 12. To facilitate entry and exit from the ski boot 1, the forward section 11 and rearward section 12 are separable along an intermediate line 13 extending from the top of the liner 10 down to approximately the ankle area and then forward to approximately the forward end of the longitudinal arch. The forward section 11 and rearward section 12 overlap along the line of separation to provide for adjustability of fit.

Figure 1:
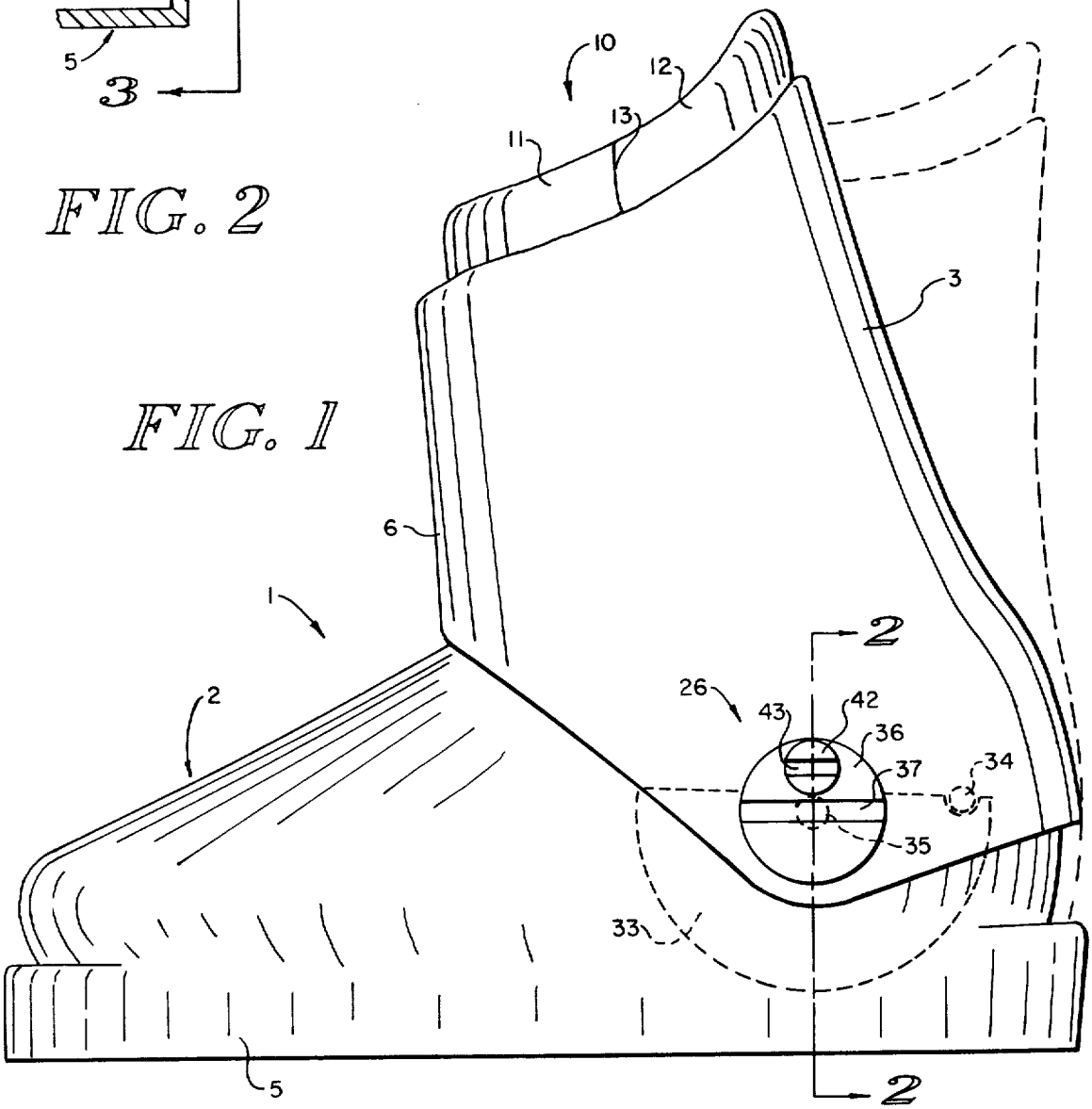
FIG. 1 is a side elevation view of a preferred embodiment of the present invention.

As seen in FIG. 1, the upper cuff member 3 is pivotaly coupled to the lower shell member 2. It may move from a position as shown in broken lines in FIG. 1 to a position approximately twenty degrees forward of a vertical line extending through the pivot axis perpendicular to the plane of the sole member 5 of the lower shell member 2. The pivot axis, as will be apparent, is approximately at the position of an ankle of a foot in the ski boot 1.

In the interior of the ski boot 1, the upper surface of the sole member 5 forms a foot bed 14 for supporting a skier's foot. In a first area provided for receiving the base of the toes of a skier's foot, there is pivotably attached to the foot bed 14, as by a screw 16 or the like, a first strap member 17. Pivotably attached to a second area of the foot bed 14, provided for receiving the base of the heel of a skier's foot, as by a screw 18 or the like, there is a second strap member 19. The strap members 17 and 19 extend from their respective areas of attachment to the foot bed 14 around the lateral aspect and over the dorsum of the foot. Typically the strap members 17 and 19 pass between the liner 10 and the interior of the lower shell member 2. There may be optionally provided, between the strap members 17 and 19 and the liner 10, a relatively rigid tongue member 20. The tongue member 20 is provided for distributing the forces applied by the strap members 17 and 19 over the upper surface of the foot engaged thereby.

At their opposite ends, the strap members 17 and 19 are pivotably connected as by rivets 27 and 29 to an elongated pivotable linking member 30. The linking member 30 is pivotably connected, as by a rivet 31, intermediate the areas of connection of the strap members 17 and 19 to a cable 32. The opposite end of the cable 32 is connected to a pulley 33 in an adjusting mechanism designated generally as 26, as by a fitting 34.

As shown more clearly in FIG. 2, the pulley 33 terminates the end of a shaft 35. The shaft 35 is rotatably supported in a bore in the lower shell member 2 and upper cuff member 3 and functions as a pivot axis for the pivoting of the upper cuff member 3 relative to the lower shell member 2. A knob member 36 is connected to the exterior end of the shaft 35. In the center of the knob member 36 there is provided a slot 37 for receiving a screw driver, coin or the like (not shown) for rotating the knob member 36. Interior of the knob member 36 there is a locking plate member 38. In the locking plate member 38 there is provided a plurality of locking holes 39, as seen more clearly in FIG. 3. The locking plate member 38 is fixedly attached to the upper cuff member 3, as by a rivet 40 permanently inserted in a hole 41 provided therefore in the upper cuff member 3, as seen more clearly in FIG. 2. For releasably coupling the knob member 36, shaft 35 and pulley 33 to the upper cuff member 3, there is, for engaging one of the plurality of locking holes 39, a set screw member 42 or the like threadably inserted in the knob member 36. In the set screw member 42 there is provided a slot 43 for receiving a screw driver, coin or the like (not shown) for turning the set screw member 42 in opposite directions for engaging and disengaging the set screw member 42 from one of the locking holes 39. For guiding the cable 32 around the periphery of the pulley 33 there is provided a groove 44 in the periphery of the pulley 33. As seen in FIG. 2, a clearance slot 45 is provided for the lower portion of the pulley 33 and the cable 32 in the foot bed 14 of the sole member 5.

Typically, the knob member 36 is approximately one and one half inches in diameter and the pulley 33 is approximately three inches in diameter. The strap members 17 and 19 may be made of leather or synthetic material. The linking member 30 is approximately two inches in length between the rivets 27 and 29, and is located on the superior medial aspect of the longitudinal arch forward of the medial malleolus. The rivet 31 for connecting the cable 32 to the linking member 30 is located approximately three quarters of an inch forward of the rivet 29. Preferably, the lower end of the strap member 17 is pivotably attached to the foot bed 14 at the forward end of the longitudinal arch under the distal lateral metatarsal heads and passes around the lateral aspect of the forefoot and over the dorsum of the foot. The lower end of the strap member 19 is pivotably attached to the foot bed 14 at the rearward end of the longitudinal arch, under the base of the calcaneous, passes around the lateral aspect of the heel forward of the lateral malleolus and over the instep. The liner 10 generally comprises a molded closed-cell urethane.

In use, the single buckle assembly 7 is pivoted outwardly, releasing the single buckle assembly 7 from the front cuff flap 6 allowing the front cuff flap 6 to open in a conventional manner. The upper cuff member 3 may then be pivoted rearwardly about the shaft 35 until the lower rear edge of the upper cuff member 3 is stopped by the upper rear edge of the sole member 5, as shown in broken lines in FIG. 1. The liner rearward section 12 overlying the posterior aspect of the calf is then pivoted in a clockwise or rearward direction, allowing the foot to enter the boot. Alternatively, the liner rearward section 12 may be secured to and pivot with the upper cuff member 3.

When the upper cuff member 3 is pivoted rearwardly, the pulley 33 also rotates clockwise, resulting in a relative lengthening of the cable 32 and a loosening of the forward strap member 17 and rearward strap member 19. The loosening of the strap members 17 and 19 permits the insertion of a foot into the ski boot. When the foot is in the boot, the upper cuff member 3 is pivoted forwardly or counterclockwise and the front cuff flap 6 closed by engaging the single buckle assembly 7. When the front cuff flap 6 is secured by the single buckle assemby 7, the upper cuff member 3 may pivot forwardly approximately an additional twenty degrees, but is prevented from pivoting rearwardly by the overlap of the front cuff flap 6 on the lower shell member 2.

When the upper cuff member 3 is pivoted forwardly, the pulley 33 rotates counterclockwise, resulting in a relative shortening of the cable 32 and a tightening of the forward strap member 17 and rearward strap member 19. As the strap members 17 and 19 are tightened, the linking member 30 moves and pivots about the rivet 31 resulting in relative equalization of the pressure of the forward strap member 17 and rearward strap member 19 against the foot engaged thereby.

Once the foot is in the ski boot, the initial fit, and indeed any subsequent fit, is easily adjusted from outside of the boot. This is accomplished by disengaging the set screw member 42 from one of the locking holes 39 in which it is engaged and rotating the knob member 36 as by placing a coin or the like in the slot 37 to position the set screw member 42 in another one of the locking holes 39.

For example, by rotating the knob member 36 clockwise, the strap members 17 and 19 are loosened for a given relative position of the upper cuff member 3 and lower shell member 2. Similarly, by rotating the knob member 36 counterclockwise, the strap members 17 and 19 are tightened for a given relative position of the upper cuff member 3 and lower shell member 2. Thus, once the position of the strap members 17 and 19 is adjusted as desired, the set screw member 42 may be turned for engaging the set screw member 42 in one of the appropriate locking holes 39 for locking the pulley 33 to the upper cuff member 3. A torque wrench with a predetermined setting may be conveniently used to adjust the fitting system in the ski shop.

While conventional ski boots have an essentially static fit, the fitting system of the present invention as described herein changes size and shape dynamically in response to the various maneuvers in skiing. With conventional boots during a turn, forward bending at the ankle with a tendency for hindfoot upward movement and forefoot sideways movement usually occurs when downward and sideways force is applied to the leading edges of the skis. Rearward bending at the ankle with a tendency for forefoot upward and sideways movement usually occurs whem the ski tips are raised. This is because a slight looseness in the fit is ordinarily provided for comfort and adequate circulation to prevent coldness, fatigue, and pain. With the present invention, maximum restraint of upward, forward, rearward, and sideways movement of the foot is provided, while also providing the maximum transmission of energy between the foot and the release binding. This is accomplished with the fitting system of the present invention in two ways. Firstly, any hindfoot upward movement that occurs tightens the forward strap member 17 by causing a counterclockwise rotation of the linking member 30 about the rivet 31, thereby minimizing any forefoot instability and maximizing energy transmission. Likewise, any forefoot upward movement tightens the rearward strap member 19. Secondly, forward bending at the ankle causes the upper cuff member 3 to pivot forwardly relative to the lower shell member 2 with consequent counterclockwise rotation of the pulley 33, thereby relatively shortening the cable 32, tightening the forward strap member 17 and rearward strap member 19 and reducing the size of the interior of the liner 10.

If desired, the strap members 17 and 19 may be made slightly elastic or a spring connected between the cable 32 and the linking member 30 for shock absorption. Dead air space insulation is inherent in the fitting system because the fit is not determined by contact between the shell and the foot.

Figure 7:
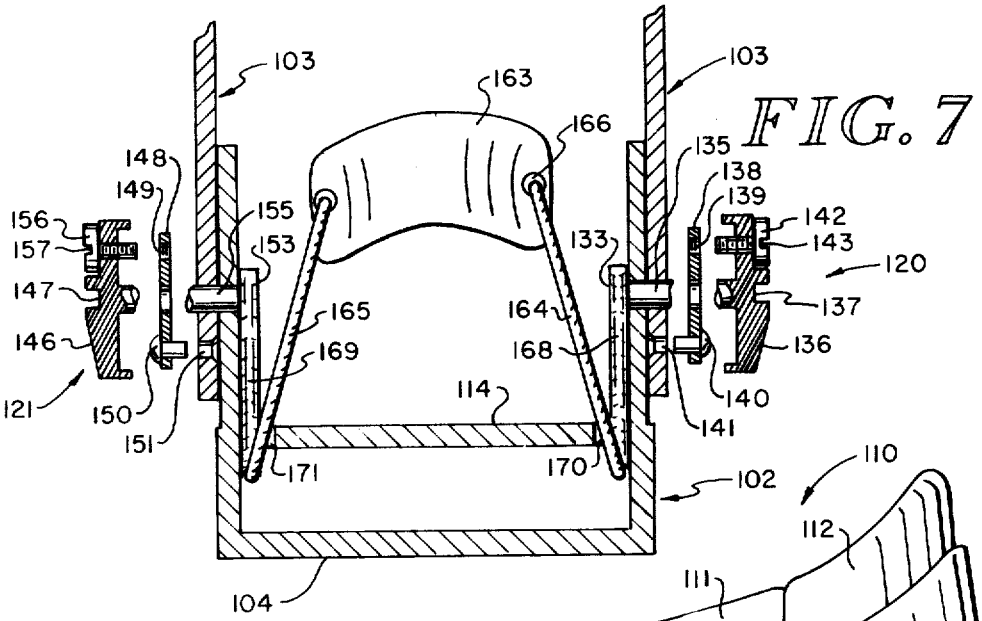
FIG. 7 is a partial cross-section view taken in the direction of lines 7—7 of FIG. 6.
Figure 6:
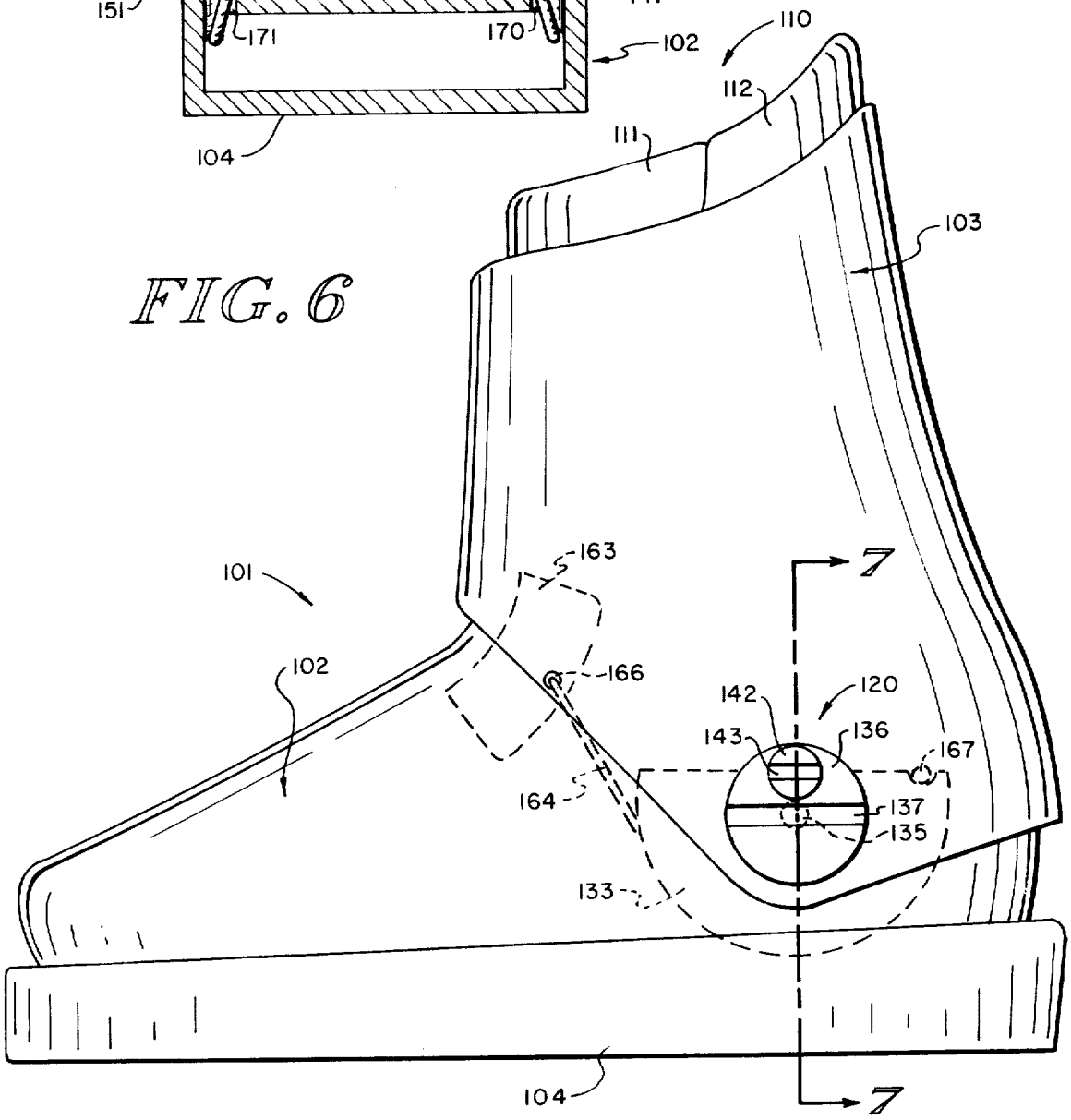
FIG. 6 is a side elevation view of an alternative embodiment of the present invention.

Referring to FIGS. 6 and 7, there is provided in an alternative embodiment of the present invention, a ski boot designated generally as 101. Ski boot 101 is substantially identical to ski boot 1 of FIGS. 1-5 and comprises a lower shell member 102 and an upper cuff member 103. In the lower shell member 102 there is provided a sole member 104. The upper surface of the sole member 104 forms a foot bed 114, as seen more clearly in FIG. 7. Interior of the lower shell member 102 and upper cuff member 103, there is a liner 110 having a forward section 111 and a rearward section 112, essentially identical to the liner 10 of FIGS. 1-5. Releasably coupled to the upper cuff member 103, there is a pair of adjusting mechanisms, designated generally as 120 and 121.

The adjusting mechanisms 120 and 121 are substantially identical. The adjusting mechanism 120 includes a pulley 133 which terminates the interior end of a shaft 135. Terminating the exterior end of the shaft 135 is a knob member 136. In the knob member 136 there is provided a slot 137 for receiving a screw driver, coin or the like for turning the knob member 136. Interior of the knob member 136 there is a locking plate member 138 with a plurality of locking holes 139. Opposite the locking holes 139 there is provided a rivet 140 or the like for fixedly attaching the locking plate member 138 permanently in a hole 141 provided therefore in the upper cuff member 103. For releasably coupling the knob member 136 to the locking plate member 138, there is a set screw member 142. In the set screw member 142 there is provided a slot 143 for receiving a screw driver, coin or the like for turning the set screw member 142. The set screw member 142 is provided for releasably engaging one of the locking holes 139 in the locking plate member 138. As thus described, the adjusting mechanism 120 is substantially identical to the adjusting mechanism 26 described above with respect to the embodiments of FIGS. 1-3.

On the opposite side of the ski boot the adjusting mechanism 121 is releasably coupled to the upper cuff member 103 in the same manner as the adjusting mechanism 120 and, except for the reverse orientation of the parts, comprises each of the parts described above with respect to the adjusting mechanism 120. Accordingly, there is provided in the adjusting mechanism 121 a knob member 146 having a slot 147 for turning the knob member 146, a locking plate member 148 with a plurality of locking holes 149, an interior pulley 153 terminating the end of a shaft 155, and a rivet 150 for attaching the locking plate member 148 in a hole 151 provided therefore in the upper cuff member 103. For releasably coupling the knob member 146 to the upper cuff member 103, there is also provided a set screw member 156. In the set screw member 156 there is provided a slot 157. The slot 157 is provided for receiving a screw driver, coin or the like for turning the set screw member 156 into and out of engagement with one of the locking holes 149.

In the interior of the lower shell member 102 and upper cuff member 103 there is a tongue member 163. The tongue member 163 extends from above the ankle to the forefoot and is provided for engaging the upper surface of a skier's foot in the area of the instep. It is connected to the pulleys 133 and 153 by means of a pair of cables 164 and 165, respectively. The cables 164 and 165 are connected to the tongue member 163 at opposite lateral edges as by a pivotable rivet 166, and to the pulleys 133 and 153 by means of a fitting 167, as seen more clearly in FIG. 6. As in the pulley 33 of the embodiment of FIGS. 1–5 the pulleys 133 and 153 are also provided with grooves 168 and 169, respectively, for guiding the cables 164 and 165. For providing clearance for the lower portion of the pulleys 133 and 153, there is provided in the foot bed 114 of the sole member 104, a pair of clearance slots 170 and 171, respectively.

In use, each of the adjusting mechanisms 120 and 121 can be adjusted separately and individually for positioning the tongue member 163 on the upper surface of the foot and for applying the desired amount of tension to the tongue member 163 relative to the foot engaged thereby for any given relative position of the upper cuff member 103 and lower shell member 102. This is accomplished by disengaging the set screw member 142 from one of the locking holes 139 in which it is engaged. Once the set screw member 142 is disengaged from one of the locking holes 139, the knob member 136 can be rotated by a screw driver, coin or the like placed in the slot 137. As the knob member 136 is rotated, the length of cable wrapped around the pulley 133 will be increased or decreased. The same procedure is used for adjusting the length of cable wrapped around the pulley 153 of the adjusting mechanism 121. After the desired tension is applied to the tongue member 163, the set screw members 142 and 156 are again turned for engaging their respective locking holes for coupling the knob members 136 and 146 to the upper cuff member 103.

After the knob members 136 and 146 are coupled to the upper cuff member 103, any pivotable movement of the cuff member 103 relative to the lower shell member 102 will result in dynamic adjustment of the tension applied to and position of the tongue member 163 relative to the foot. Thus, as the upper cuff member 103 is pivoted forwardly relative to the lower shell member 102, the tension on the cables 164 and 165 is increased, pulling the tongue member 163 into tighter engagement with the foot. Conversely, when the upper cuff member 103 is pivoted rearwardly, the tension is reduced on the cables 164 and 165 and the tongue member 163 loosens relative to the foot.

Referring to FIGS. 8 and 9, there is provided in another embodiment of the present invention a ski boot 201 having a lower shell member 202, an upper cuff member 203, a sole member 204 and a liner 210 comprising a forward section 211 and a rearward section 212. Releasably coupled to the upper cuff member 203 there is an adjusting mechanism 220. The adjusting mechanism 220 includes a knob member 236. Interior of the knob member 236 there is a locking plate member 238. In the locking plate member 238 there is provided a plurality of locking holes 239 for engaging a set screw member 242 provided therefore in the knob member 236. In the set screw member 242 there is provided a slot 243 for receiving a screw driver, coin or the like for turning the set screw member 242 into and out of engagement with the locking holes 239. In the locking plate member 238 there is also a rivet 240 or the like for permanently fixedly attaching the locking plate member 238 in a hole 241 provided therefore in the upper cuff member 203.

The knob member 236 terminates an exterior end of a shaft 235. The shaft 235 extends transversely through the sole member 204 beneath an interior foot bed 214 located in the interior of the lower shell member 202. Connected to the shaft 235 adjacent to respective interior wall surfaces of the sole member 204 there is a pair of spaced pulleys 233 and 253. The shaft 235 includes a flange butt 244 for preventing the upper cuff member 203 from slipping laterally from the shaft 235. The pulleys 235 and 253 are connected to a tongue member 263 as by a pair of cables 264 and 265. Located adjacent to the pulleys 233 and 253 there is provided in the foot bed 214 a pair of clearance slots 266 and 267. The slots 266 and 267 are provided for the pulleys 233 and 253.

The adjusting mechanism 220 of the embodiment of FIGS. 8 and 9 is adjusted in the same manner as the mechanism described above with respect to FIGS. 6 and 7. The principal difference is the location of the pulleys 233 and 253 relative to the position of the pulleys 133 and 153 of FIGS. 6 and 7. In the embodiment of FIGS. 8 and 9, the axis of rotation of the pulleys 233 and 253 is placed below the plane of the foot bed 214. By placing the axis of rotation of the pulleys 233 and 253 below the plane of the foot bed 214, both of the pulleys 233 and 253 may be connected to the common shaft 235 and the single knob member 236 employed for adjusting the mechanism 220.

As seen more clearly in FIG. 8, in order to use the common shaft 235 for connecting the pulleys 233 and 253, and retain the dynamic adjusting feature of the previous embodiments, it is necessary to extend the lower portion of the upper cuff member 203 below the plane of the foot bed 214 and to provide a clearance slot for the rotation thereof in the sole member 204. As is apparent, the lower placement of the adjusting mechanism 220 permits the elimination of one of the adjusting knob members from the exterior of the boot, thereby simplifying the construction and reducing the number of parts required therefore.

Figure 12:
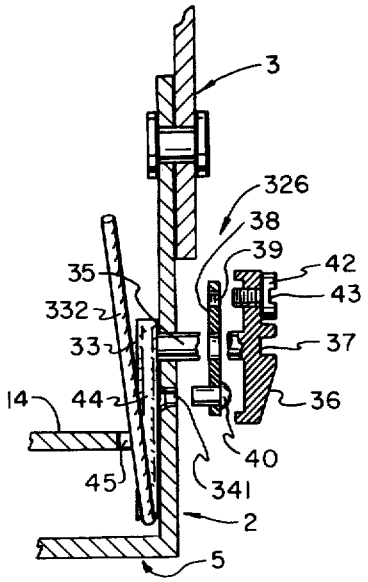
FIG. 12 is a partial cross-section view taken in the direction of lines 12—12 in FIG. 11.
Figure 10:
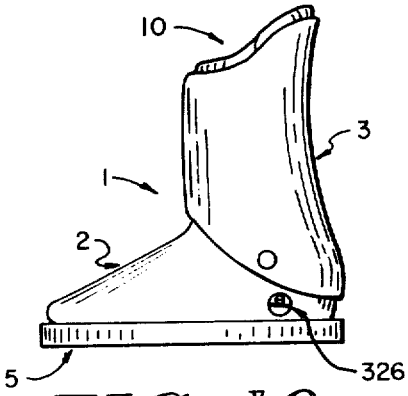
FIG. 10 is a side elevation view of still another embodiment of the present invention.
Figure 11:
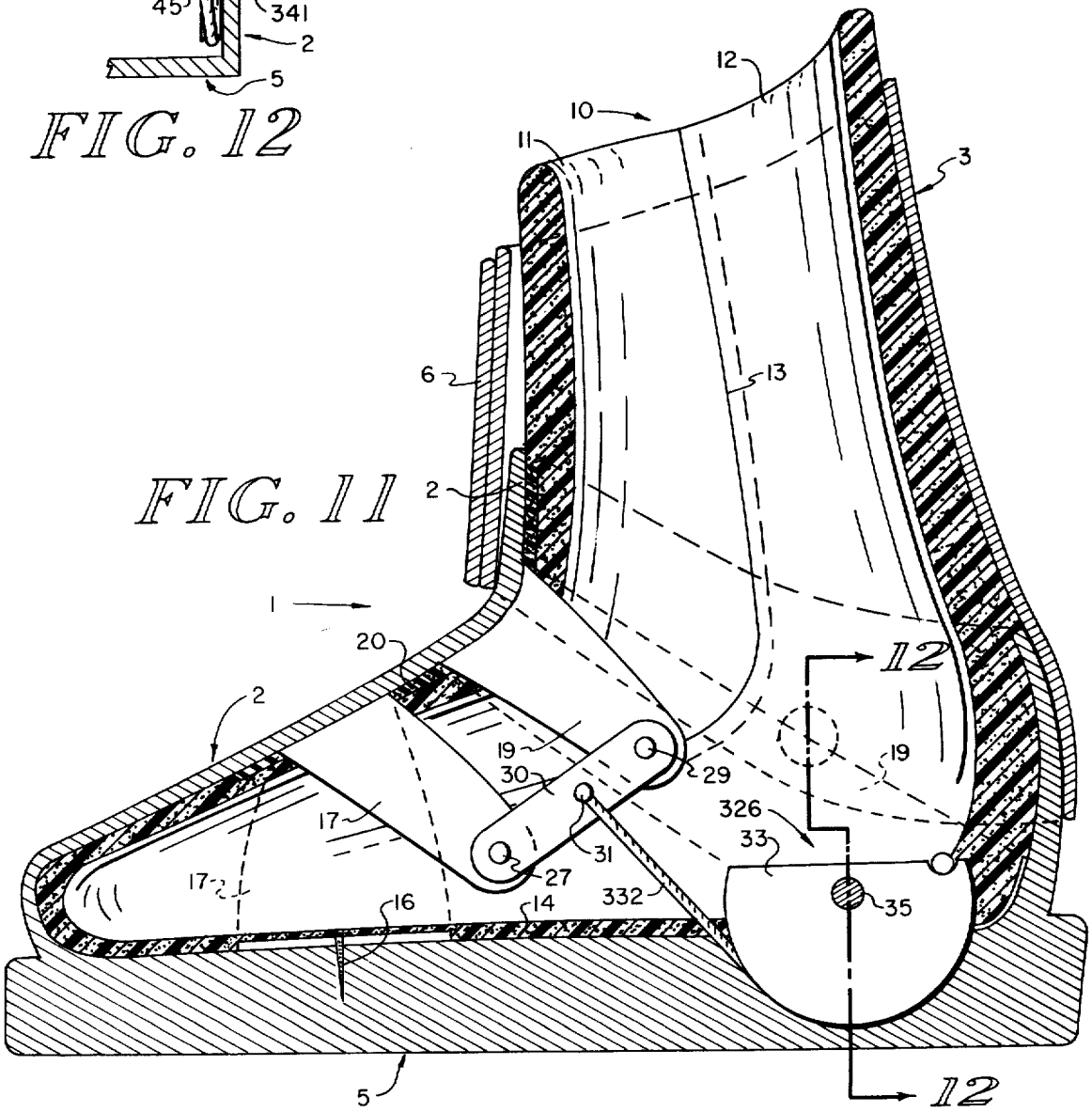
FIG. 11 is a side cross-section view showing the principal features of FIG. 10.

Referring to FIGS. 10–12, in another embodiment of the present invention, the strap members 17 and 19 and the linking member 30 of the embodiment of FIGS. 1–5 are coupled to one end of a tensioning member such as a cable or the like 332. The opposite end of the cable 332 is connected to an adjusting mechanism designated generally as 326. The cable 332 and the adjusting mechanism 326 are substantially identical to the cable 32 and the adjusting mechanism 26 of the embodiment of FIGS. 1–5. The principal differences lie in the position of the cable 332 and the adjusting mechanism 326 relative to the upper cuff member 3.

In the embodiment of FIGS. 10–12, the adjusting mechanism 326 is coupled to the lower shell member 2 of the ski boot below the lower boundary of the upper cuff member 3. The adjusting mechanism 326 is fixedly attached thereto by a rivet 40 in a hole 341 provided therefore in the lower shell member 2 of the ski boot 1.

In use, the skier adjusts the amount of tension applied to the strap members 17 and 19 by rotating the adjusting assembly 326 as described above with respect to the adjusting mechanism 26 of the embodiment of FIGS. 1-5. Since the adjusting mechanism 326 is coupled to the lower shell member 2 instead of the upper cuff member 3, any forward or rearward pivoting of the upper cuff member 3 relative to the lower shell member 2 does not affect the amount of tension applied to the cable 332. However, any tendency for hindfoot or forefoot lift will cause a movement of the strap members 17 and 19 and linking member 30 such that a redistribution of the forces involved will occur. The forces on the strap members 17 and 19 will increase the amount of tension applied to the forward strap member 17 when heel lifting movement occurs and increase the amount of force applied to the rearward strap member 19 when forefoot lifting movement occurs.

Several embodiments of the present invention are described and others are suggested. It is contemplated that still other modifications and changes will occur to those skilled in the art and can be made to the embodiments described without departing from the spirit and scope of the present invention. Accordingly, it is intended that the present invention not be limited to the embodiments described, but rather that the scope thereof be determined by reference to the claims and their equivalents hereafter provided.

What is claimed is:

1. A sport shoe comprising:

movable foot-restraining means for controlling movement of a foot in the shoe; and means responsive to a movement of the leg to which said foot is attached for moving said foot-restraining means to tighten and loosen the fit of said foot-restraining means relative to said foot as said leg is moved.

2. A sport shoe according to claim 1 wherein said foot-restraining means comprises means for engaging the upper surface of a foot, said means for moving said foot-restraining means comprises means for applying a tension to and adjusting the position of said foot-engaging means relative to said foot; and comprising means responsive to a movement of said leg for dynamically varying the magnitude of the tension applied to said foot-engaging means.

3. A dynamic internal fitting system according to claim 2 wherein the means for applying and dynamically varying the magnitude of the tension applied to and the position of the foot-engaging means relative to a foot engaged thereby comprises:

a pulley means;

a predetermined length of cable;

means for coupling one end of the cable to the foot-engaging means and the opposite end to the pulley means; and means for coupling the pulley means to the cuff member so that the pulley means rotates and the cable is wrapped about and unwraps from the pulley means as the cuff member is moved relative to the shell member.

4. A dynamic internal fitting system according to claim 3 wherein the tension-applying means and position-adjusting means comprises:

means for selectively adjusting the magnitude of the tension applied to and the position of the foot-engaging means relative to a foot engaged thereby when the cuff and shell members are in a given relative position.

5. A dynamic internal fitting system according to claim 4 wherein said selective adjusting means comprises means for selectively adjusting the amount of the cable wrapped about the pulley means when the cuff and shell members are in a given relative position.

6. A dynamic internal fitting system according to claim 5 wherein said means for selectively adjusting the amount of the cable wrapped about the pulley means when the cuff and shell members are in a given relative position comprises means for manually rotating the pulley means relative to the cuff member when a desired amount of tension is applied to the foot-engaging means with the cuff and shell members in the given relative position.

7. A dynamic internal fitting system according to claim 6 wherein the means for selectively rotating the pulley means comprises a knob member on the outside of the cuff member and a shaft for connecting the knob member to the pulley means and the locking means comprises:

a locking plate member fixedly attached to the cuff member;

a plurality of locking holes in the plate member; and means located in the knob member for releasably engaging the locking holes in the locking plate member.

8. A dynamic internal fitting system according to claim 7 wherein the hole-engaging means comprises a screw member threadedly screwed into the knob member and means for screwing the screw member in a first direction for engaging the locking holes and for screwing the screw member in a second direction for disengaging the locking holes.

9. A dynamic internal fitting system according to claim 3 wherein the shell member includes a sole; the foot-engaging means includes strap means and means for attaching one end of the strap means to the shell; and the cable coupling means includes means for attaching the cable to the opposite end of the strap means.

10. A dynamic internal fitting system according to claim 9 wherein the shell comprises a first area for receiving the forefoot and a second area for receiving the hindfoot; the strap means comprises a first strap means and means for attaching one end of the first strap means to the first shell area; a second strap means and means for attaching one end of the second strap means to the second shell area; and the means for attaching the cable means to the strap means comprises:

a linking member;

means for attaching the opposite ends of the first and the second strap means to the opposite ends of the linking member, respectively, and means for attaching the cable means to the linking member at a point intermediate the point of attachment of the first and the second strap means thereto.

11. A dynamic internal fitting system according to claim 10 wherein the cable means is attached to the linking member at a point off center of the linking member so that, when a foot during a forward lean tends toward heel-lifting movement, a force thereby applied to the second strap means will cause a proportionate force to be applied to the first strap means.

12. A dynamic internal fitting system according to claim 11 wherein the point of attachment of the cable means to the linking member is closer to the second strap means than the first strap means.

13. A dynamic internal fitting system according to claim 3 wherein the foot-engaging means comprises a tongue member and the predetermined length of cable comprises a pair of cables of predetermined length extending, respectively, from opposite lateral edges of the tongue member along the opposite sides of a foot engaged thereby for coupling the tongue member to the pulley means.

14. A dynamic internal fitting system according to claim 12 wherein the pulley means comprises a first and second pulley means located on opposite sides of the cuff member and each one of the pair of cables is coupled to an associated one of the first and second pulley means.

15. A dynamic internal fitting system according to claim 14 comprising means for releasably locking each of the first and second pulley means to the cuff member so that the pulley means rotates with a movement of the cuff member; and means for independently selectively adjusting the amount of cable wrapped about each of the first and second pulley means when the cuff and shell members are in a given relative position.

16. A dynamic internal fitting system according to claim 15 wherein the means for selectively adjusting the amount of the cable wrapped about the pulley means comprises means for manually selectively rotating the pulley means relative to the cuff member; and means for locking the pulley means to the cuff member when a desired amount of tension is applied to the foot-engaging means with the cuff and lower shell members in the given relative position.

17. A dynamic internal fitting system according to claim 16 wherein the means for selectively rotating the pulley means comprises a knob member on the outside of the cuff member and a shaft for connecting the knob member to the pulley means and the locking means comprises:

a locking plate member fixedly attached to the cuff member; and means disposed in the knob member for releasably engaging holes in the locking plate member.

18. A dynamic internal fitting system according to claim 17 wherein the hole-engaging means comprises a screw member threadedly screwed into the knob member and means for screwing the screw member in a first direction for engaging the locking holes and for screwing the screw member in a second direction for disengaging the locking holes.

19. A dynamic internal fitting system according to claim 14 wherein the pulley means comprises:

a shaft mounted to the sole of the ski boot which extends transversely through the sole of the ski boot;

means for fitting the first and second pulley means to corresponding ends of the shaft;

means for releasably locking the shaft and the first and second pulley means to the cuff member; and means for selectively adjusting the amount of cable wrapped about each of the first and second pulley means when the cuff and lower shell members are in a given relative position.

20. A sport shoe according to claim 1 wherein said means for moving said foot-restraining means comprises means for tightening said fit of said foot-restraining means when said leg is moved forwardly toward the toe of said foot and loosening said fit of said foot-restraining means when said leg is moved rearwardly.

21. A sport shoe according to claim 20 wherein said means for tightening and loosening said fit of said foot-restraining means comprises a movable cuff member; and means coupling said foot-restraining means to said cuff member for moving said foot-restraining means as said cuff member is moved.

22. A sport shoe according to claim 21 wherein said foot-restraining means comprises means for engaging the instep of said foot.

23. A sport shoe according to claim 21 wherein said coupling means comprises a cable and pulley means for coupling said cuff member and said foot-restraining means.

24. A sport shoe according to claim 23 wherein said cable and pulley means for coupling said cuff member and said foot-restraining means comprises:

pulley means;

a length of cable;

means for adjustably attaching said pulley means to said movable cuff member; and means attaching said length of cable to said pulley means for winding and unwinding said cable on and from said pulley means as said cuff member is moved forwardly and rearwardly.

25. A sport shoe according to claim 24 wherein said means for adjustably attaching said pulley means to said movable cuff member comprises means for adjusting the amount of said cable wound on said pulley means with said cuff member held in a fixed position.

26. An internal fitting system in a sport shoe having a shell member comprising:

a first strap member;

a second strap member;

an elongated linking member;

a tensioning member;

means for attaching one end of the first and the second strap members to the shell member, said first and said second strap members engaging the upper surface of a foot;

means for attaching the opposite ends of the first and the second strap members to opposite ends of the linking member;

means for attaching one end of the tensioning member to the linking member at a point intermediate the points of attachment of the first and the second strap members thereto; and means coupled to the opposite end of the tensioning member for selectively applying a tension to the first and the second strap members.

27. An internal fitting system according to claim 18 comprising means for attaching the first strap member to an area of the shell member which is provided for receiving and supporting the forefoot and the second strap member to an area of the shell member which is provided for receiving and supporting the hindfoot; and means for pivatably attaching the opposite ends of the first and second strap members to the linking member.

28. An internal fitting system according to claim 27 comprising:

a cable;

a pulley assembly including a pulley member rotatably coupled to the sport shoe;

means for attaching one end of the cable to the linking member and the opposite end of the cable to the pulley member;

means for rotating the pulley member to wrap and unwrap the cable about the pulley member so as to selectively adjust the position of the strap members relative to a foot engaged thereby; and means for releasably locking the pulley member to the sport shoe after the strap members have been moved to the selected position.

* * * * *